US007731643B2

(12) United States Patent
Harrison

(10) Patent No.: US 7,731,643 B2
(45) Date of Patent: Jun. 8, 2010

(54) EXERCISE MACHINE

(76) Inventor: John James Harrison, White House, Caldwell, Richmond, North Yorkshire (GB) DL 117PU ( * ) Notice: Subject to any disclaimer, the term of this patent is extended or adjusted under 35 U.S.C. 154(b) by 0 days.

(21) Appl. No.: 12/037,827

(22) Filed: Feb. 26, 2008

(65) Prior Publication Data

US 2008/0234115 A1 Sep. 25, 2008

Related U.S. Application Data

(63) Continuation-in-part of application No. 10/206,439, filed on Jul. 23, 2002, now Pat. No. 7,335,144.

(30) Foreign Application Priority Data

Jul. 26, 2001 (GB) ..... 0118228.6
Mar. 14, 2002 (GB) ..... 0205961.6

(51) Int. Cl.
*A63B 21/00* (2006.01)
*A63B 21/08* (2006.01)
*A63B 21/062* (2006.01)

(52) U.S. Cl. ..... 482/137; 482/97; 482/100

(58) Field of Classification Search ..... 482/93–103, 482/135–138
See application file for complete search history.

(56) References Cited

U.S. PATENT DOCUMENTS

| | | | | |
|---|---|---|---|---|
| 1,547,268 | A * | 7/1925 | Faustino Sotomayor | 482/103 |
| 5,018,725 | A * | 5/1991 | Cook | 482/103 |
| 5,102,122 | A * | 4/1992 | Piane et al. | 482/133 |
| 5,308,304 | A | 5/1994 | Habing | |
| 5,800,321 | A | 9/1998 | Webber | |
| 5,938,574 | A | 8/1999 | Webber | |
| 6,394,935 | B1 | 5/2002 | Lake | |
| 6,579,213 | B1 | 6/2003 | Webber et al. | |
| 6,705,976 | B1 * | 3/2004 | Piane, Jr. | 482/103 |

* cited by examiner

*Primary Examiner*—Fenn C Mathew
(74) *Attorney, Agent, or Firm*—Pedersen & Company, PLLC; Barbara S. Pedersen; Ken J. Pedersen

(57) ABSTRACT

An exercise machine for exercising the muscles of the upper body, in which a pushing or pulling movement can be performed in a direction approximately between horizontal and vertical towards or away from the shoulder joint of the user, with the user seated in the same position.

22 Claims, 8 Drawing Sheets

EXERCISE MACHINE

This application claims priority, and is a continuation-in-part of Ser. No. 10/206,439, filed Jul. 23, 2002, now U.S. Pat. No. 7,335,144, the entire disclosure of which is incorporated herein by this reference, and this application claims priority of GB 0118228.6, filed Jul. 26, 2001, and GB0205961.6, filed Mar. 14, 2002.

BACKGROUND OF THE INVENTION

1. Field of the Invention

The invention relates to exercise machines, in particular those which are used to exercise the muscles of the upper body, being the back, chest and shoulders.

The muscles of the back are used in movements which involve moving the hands towards the body, typically a pulling movement. This can mean a rowing movement, where usually both hands are pulled from being outstretched in front of the body to the chest, or a pull-up movement where the hands grasp a secure point above the head and the body is lifted until the head is level with the point. The chest muscles are used to push the hands away from the body to become outstretched in front of the body, approximately opposite to a rowing movement. The shoulder muscles are used to lift the hands above the head, which is the opposite to a pull-up movement.

2. Related Art

Current machines that allow a rowing movement are of two types in which the user is either seated or sanding. With seated machines, the user either sits on the floor or on a seat, and pulls on a bar attached to the end of a cable that is passed beneath one pulley and over the top of a second pulley attached to a weight. The second pulley is positioned above the first such that, when the cable is pulled, the weight is lifted towards the second pulley, providing resistance to the pulling movement. A further type of machine used in a seated rowing movement uses a pivot with two arms attached to it at approximately 90 degrees to each other. One aim is approximately vertical, with a bar or handle fixed on its end for the user to hold and pull, and the second arm is approximately horizontal with weights attached to its end. When the first arm is pulled on, it rotates about the pivot and rotates the second arm about the pivot, lifting the weight, and providing resistance to the pulling movement.

A machine that is used with the user standing comprises an arm, one end of which is pivotally fixed to the floor with weights placed on the other end. A handle is fixed towards the weighted end of the aim. The user stands astride the arm and grasps the handle and, whilst bent over, lifts the weight towards his chest in a rowing action.

Machines that allow a pull-up movement comprise a cable, one end of which is pulled on by the user, wherein the cable extends vertically above the user to a pulley. The cable is tuned around this pulley until it is horizontal and then around a further pulley until it is vertical, with its end being attached to a weight. The user pulls down on the cable and the cable turns around the two pulleys and lifts the weight to provide resistance. Pivot type machines are also used for pull-up type vertical movements.

Machines have also been used that allow horizontal and vertical movements to be carried out on the same machine. These usually comprise a combination of the two types of machine that use cables. Here, the cable from the vertical movement is extended and passed around a pulley close to the floor. The user sits on the floor and pulls on the end of this cable.

Machines that are used to exercise the chest with the user in a seated position often use an approximately vertical arm attached to a pivot with a further arm attached to the pivot onto the end of which weights are placed. A handle is placed on the end of the first arm and the user pushes on the handle, which rotates both arms about the pivot and lifts the weight. The pivot can be above the head of the user or close to the floor. The resistance can also be provided by a system of pulleys lifting a weight stack. With this type of machine, the exercise movement is along a circular arc about the pivot. Some machines also use a track which runs parallel to the direction of movement of the exercise giving a linear movement.

The shoulder muscles are also exercised on similar machines with pivots or parallel tracks. When the shoulder muscles are exercised in a seated position, the pivot is usually positioned at a point just above the shoulder joint of the user with the arm, which the user holds approximately horizontal.

The limitations of current machines for exercising the back muscles are that, when vertical and horizontal movements are combined on the same machine, saving the number of machines and the amount of weight required, then additional pulleys increase friction on the movement and reduce the effectiveness of the movement, particularly when the weight is lowered, because friction helps to lower the force needed to control the lowering of the weight. The machines also use different body positions for the user, for example, sitting on a seat for one movement and on the floor for another, making the machine uncomfortable and inconvenient to use.

Some machines also allow the muscles of the back, chest and shoulders to be exercised on the same machine. These use different methods to exercise each muscle group, for example, the chest is often exercised on a pivoted arm, and the vertical pull downs for the back performed with a cable passing over a pulley and lifting a weight. The position of the body of the user may also be different for exercising different muscles. For example, the user may sit in an upright position to exercise his chest and have to lean forwards to exercise his shoulders with the same equipment.

Another limitation is that only approximately horizontal and vertical type pushing or pulling movements are allowed on current machines, however, the muscles of the back are capable of pulling movements at any angle between horizontal or below, and vertical, and the muscles of the chest and shoulders can push at any angle between horizontal and vertical.

SUMMARY OF INVENTION

The present invention provides a machine for exercising any or all of the muscles of the back, chest and shoulders comprising a means of supporting a grasp point such that it can be moved in a direction that is approximately towards or away from the shoulder joint of the user from or to any point on an approximately circular arc the center of the circular arc being approximately the shoulder joint of the user.

The grasp point, that is the point which the user holds when performing the exercise, may be supported in many embodiments such that its movement, when the exercise is carried out, is approximately along a line between the initial position of the grasp point and the shoulder joint of the user. In some embodiments, the grasp point may be moved/adjusted to various positions along an approximately circular arc the center of which is approximately the shoulder joint of the user. In alternative embodiments, the grasp point support structure may rotate about an axis at or a small distance below the shoulder joint of the user. Such movement/adjustment and/or rotation allows the pulling exercise to be carried out such that the initial position of the arms of the user can be anywhere between outstretched vertically above the head of the user to outstretched in front of the user horizontally or below, wherein the movement is carried out in approximately the same direction as the arms when in the initial position, that is, generally parallel to the outstretched arms. Vertical is taken to mean above the head of the user when standing or seated in an upright position and horizontal taken to mean straight in front of the user. Moving/adjusting the grasp point or grasp point support structure along a circular arc or rotating the grasp point around the point close to the shoulder joint of the user, allows it to move such that the arms of the user can be extended to reach the grasp point anywhere between vertical or slightly past vertical, and horizontal or below. This allows the muscles of the chest, back or shoulders to be exercised from any angle between horizontal or below and vertical or above. This allows one machine to be used to carry out any rowing, pulling or pull down movements and the muscles of the back exercised from any angle, with the user remaining seated in the same position.

Embodiments of the invented machine may be used to carry out pushing exercises between horizontal and vertical to exercise the muscles of the chest and shoulders. Pushing exercises for the chest and shoulders can be performed with the hands of the user starting close to the shoulder joint of the user and pushing away from that point in any direction between vertical and horizontal or below. The grasp point(s) for such a pushing exercise machine may be moved to various locations, to allow said pushing in any direction, by moving support structure for the grasp point along a circular arc or rotating the support structure about an axis at or a small distance below the shoulder joint of the user.

Machines according to embodiments of the invention may combine pulling and pushing movements at any angle between vertical or above (slightly past vertical) and horizontal or below. Such machines may serve to exercise the muscles that benefit from pushing, the muscles that benefit from pushing, and the muscles, such as the arms, that benefit from both pulling and pushing exercises. Thus, machines may be provided according of the invention that allow either push only, pull only, or both push and pull. Resistance may be provided to either the pulling exercises and the pushing exercises in consecutive movements, or just the pulling exercises, or just the pushing exercises. Resistance to pushing exercises may be provided in which grasp point support structure or other control structure controls the direction of the grasp point as it is pushed away from the user, or in which the user is required to control the direction of the grasp point as the grasp point is moved away from the body.

It is preferable to provide a means of allowing the grasp point to be positioned so as to allow the direction of exercise movements to between approximately vertical or above and horizontal or below. In alternative embodiments, the allowed movements may also be limited to a smaller range of angles between the two extremes.

One means of providing a path for pulling exercises is to provide resistance by pulling of a cable to lift a weight. A pulley may be placed close to the grasp point, which allows the cable to pass round the pulley close to the initial grasp point as the movement is carried out. The pulley can be supported and moved around a circular arc with the center of the arc approximately at the shoulder joint of the user. With this system for back exercises, it is preferable that the circular arc, about which the grasp point is adjusted, is formed from a continuous member covering at least one quarter of a circle, so that, after adjustment of the grasp point starting position, the exercise movement can be started from any position between the hands outstretched in front of the user to the hands stretched above the head of the user.

Another means of providing a path for exercise can be carried out is to use a pivot with an arm extending to either side. A grasp point or handle is placed at one end of one am and a weight at the end of the other. The user pulls on the grasp point/handle and lifts the weight about the pivot. The pivot point is movable along an arc to allow the pulling exercise to be carried out from any angle, with the initial position of the arms being in a range from outstretched above the head of the user to being below horizontal in front of the user. This method can also be used for pushing exercises, for the chest or shoulders for example. Here, the arm with the weight can be allowed to rotate on the pivot independently of the aim with the handle/grasp point attached to it. This allows the weighted arm to be independently rotated to a position that causes it to lift the weights when the handle or grasp point is pulled on, rather than when the handle or grasp point is pushed on.

Another means of providing a path on which exercise can be carried out is to provide a rotatable arm that may be pivoted at a point just below the shoulder joint of the user. The rotatable aim is positioned to one side of the user when seated and extends above the head height of the user. A cross member extends from the top end of the rotatable arm to reach across toward the head of the user. Pivotally fixed to end of the cross member are two arms that have handles on their ends. The two arms can be pulled towards or pushed away from the user in a horizontal direction. The first, rotatable aim can be rotated about the pivot to a position close to horizontal. Now the two arms can be pushed or pulled vertically by the user. A means of providing resistance to the exercise can be provided by a weighted arm rotating on a shaft.

A detailed description of several, but not the only, embodiments of the machine will now be given with reference to the following figures.

DETAILED DESCRIPTION OF PREFERRED EMBODIMENTS

Figure 1:
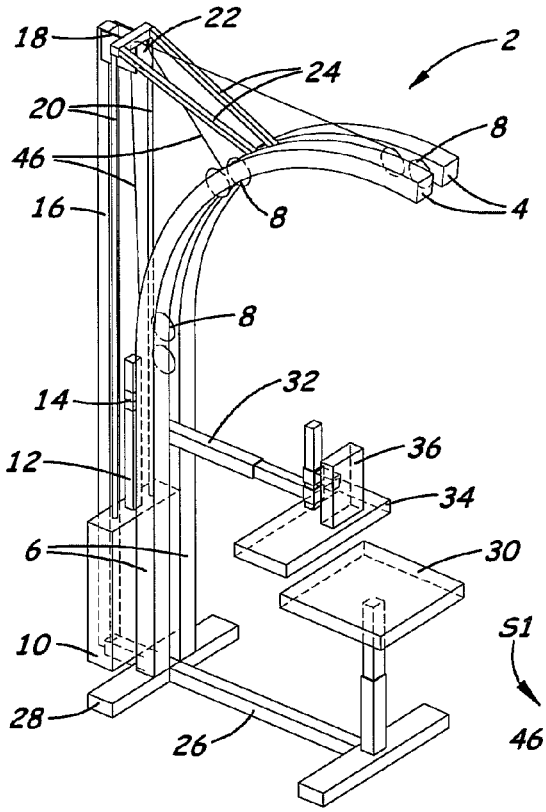
FIG. 1 shows a perspective view of the machine according to a first embodiment of the invention.

Referring to the Figures, there are shown some, but the only, embodiments of the invented exercise machine.

An embodiment of the invention will now be described with reference to FIGS. 1, 2 and 3. The machine 2 comprises a pair of curved members 4 supported by a pair of vertical members 6. Running on members 4 is pulley mounting 8. A weight 10 is positioned next to members 6. Fixed to the top of weight 10 is tube 12 with small weight 14 free to slide up and down inside it. A further member 16 extends vertically from behind weight 10. A pair of plates 18 extend from the top end of member 16 to above weight 10. Two rods 20 extend through weight 10 up to plates 18. Top pulley 22 is mounted on plates 18. A pair on members 24 connect plates 18 to curved members 4. Member 26 extends along the floor below members 4. Member 28 extends along the floor from the bottom of members 6 to either side of the machine to provide stability. Fixed to the end of member 26 is seat 30. Member 32 extends from members 6 and supports leg rest 34 and chest rest 36.

Figure 2:
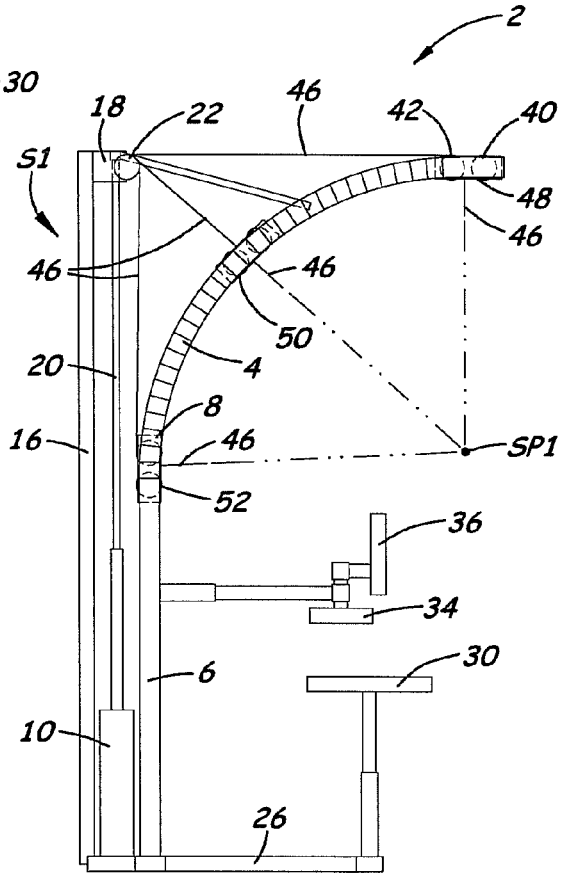
FIG. 2 shows a side elevation of the embodiment of FIG. 1.
Figure 3:
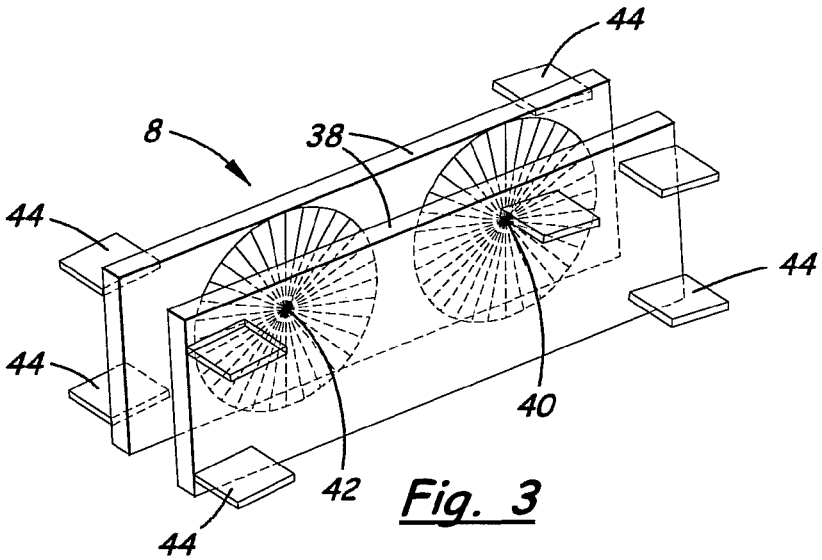
FIG. 3 shows a perspective view of part of the embodiment of FIGS. 1 and 2.

Pulley mounting 8 is shown in FIG. 3. It comprises a pair of plates 38 with pulleys 40, 42 mounted between them. Runners 44 are fixed on either side of plates 38 and run either side of members 4. A cable 46 FIG. 2, runs from pulley mounting 8 between pulleys 40 42 and curved members 4, over pulley 22 and down to small weight 14.

When in use the pulley mounting 8 is positioned above the head of the user for example, position 48 FIG. 2, and an attachment such as a bar is placed on the end of cable 46 for the user to grasp. Thus the end of cable 46 forms the grasp point. The user sits on seat 30 and pulls down on cable 46 which passes round pulley 42 and over pulley 22 down to small weight 14. Small weight 14 is fastened to tube 12 and weight 10 which is lifted and slides along rods 20 to maintain its position. The legs of the user are placed under leg rest 34 to prevent the user lifting himself up and weight 10 staying in its initial position. Thus the user can perform a pull down exercise with the pulley mounting and the grasp point above the users head and pulling the cable down to a point behind his head.

Pulley mounting 8 can be held in position by a pin placed in holes in runners 44 and curved members 4. Small weight 14 can be held in position in tube 12 by a pin placed in a hole in weight 14 and tube 12.

To perform a pulling movement which the grasp point is at positioned such that the aims are at 45 degrees to the horizontal when the exercise is started, the pulley mounting 8 is moved around the curved members 4 until the grasp point is in such a position, point 50. The pulley mounting and pulleys 40, 42 are now closer to top pulley 22 and cable 46 becomes slack. To take up this slack small weight 14 is allowed to fall inside tube 12 and pull the cable tight. A pin can be placed in a hole in weight 14 and tube 12 to hold weight 14 in place in tube 12 and allow weight 10 to be lifted when cable 46 is pulled. The exercise can now be carried out with the grasp point pulled towards the chest of the user. The movement, being at 45 degrees, may well allow cable 46 to pass directly between pulleys 40, 42 and straight to and over pulley 22. Pulleys 40 42 may only be turned slightly as the movement is carried out as the user may not pull in a straight line. In a similar way to the pull down exercise the legs of the user are placed beneath leg rest 34 to prevent the user being lifted whilst performing the exercise. The movement, being at 45 degrees now has a horizontal component, tending to pull the user forwards towards the machine. This is prevented by the chest of the user being placed against the chest rest 36.

A rowing movement, with the grasp point being pulled horizontally towards the chest of the user from a position with the arms of the user being stretched out in front of him, can also be performed. Here the pulley mounting is moved around curved members 4 until it reaches point 52. The cable now passes around the bottom of pulley 40 and up to and over top pulley 22 and down to small weight 14. Pulley mounting 8 is now further from pulley 22 so cable 46 must be longer. This is accommodated by allowing small weight 14 to slide up tube 12 and be held in place with a pin through holes in the small weight and the tube. The exercise can now be performed with the user pulling the grasp point horizontally towards his chest.

In order to accommodate different heights and sizes of user with differing arm lengths, the height of seat 30 can be made adjustable as can the height of the leg rest 34 and chest rest 36. The distance of the leg rest and chest rest from the pulley mounting in the position to allow horizontal movements can also be made adjustable, accommodating different lengths of arms. When the pulley mounting is in a position to allow overhead pull down movements it may be more comfortable if the chest rest can be removed, and the leg rest removed when horizontal movements are carried out. Thus it is preferred that the chest rest and the leg rest are removable.

The seat, leg rest, and chest rest can be made removable and adjustable by supporting them with telescopic members, comprising a smaller member sliding in or out of a fixed larger member, both members having holes in them, in which a pin can be placed to allow the sliding member to be fixed in one of a number of positions. This system of adjustment is known.

When the machine is used for overhead pull downs, or at any position with the pulley mounting to allow pulling at approximately 45 degrees or steeper, the cable only passes over and turns pulley 42 and pulley 22. When the pulley mounting is positioned to allow horizontal movements and those below approximately 45 degrees, the cable only passes over and turns pulleys 40 and 22. Thus, a minimum number of pulleys are used to perform the exercise keeping friction low and the exercise as effective as possible.

The pulley mounting can be placed in any position on the curved members, so a pulling movement can be carried out from any angle between the aims vertical above the head of the user, to in front of the user the arms horizontal or below horizontal.

The pulley mounting is held in place on the curved member with pins placed in holes through the pulley mounting and the curved member. Other means can also be used including clamps or bolts. Similarly, small weight 14 is held on place in tube 12 with a pin in a hole through the tube and the small weight. Other means can also be used to hold the small weight on one position in the tube.

Curved members 4 are not necessarily required to support the pulley mounting, a number of support points which allow the pulley mounting to be positioned approximately on a circular arc with its center approximately at the shoulder joint of the user are all that is required to support the pulley mounting. The positions preferably allow the pulley mounting to be fixed at points between above the head of the user and a point which allows the arms of the user are below horizontal. Tube 12 and small weight 14 are not only means of taking tip any slack on cable 46. It is possible to position a further pulley close to and below the pulley mounting when in the position for a horizontal movement. Pulley 40 is no longer required and the cable is passed over pulley 42 and under the new pulley and up and over the top pulley 22. The new pulley is preferably positioned so that any slack is taken up by this pulley when the pulley mounting is at any point on the arc with its center at the shoulder joint of the user. The new pulley can be fixed on one position, or movable to take up any slack.

The grasp point can be designed to allow many different bars and attachments to be attached to it. These include bars and hand grips which allow the hands to be positioned a variety of distances apart and at a variety of different angles.

It may be said that the embodiment in FIGS. 1-3 comprises a stand S1 and a grasp point that is moveable on the stand to various positions relative to the seat 30 on which the user sits, and, therefore, relative to the user and his shoulder. The various positions define a curved arc centered at a shoulder-point SP1, as shown in FIG. 2, which is above the seat 30 and generally corresponding to the location of the shoulder of the user of the machine. With the grasp point selectively located at one of said various positions defining the curved arc, the user moves the handle of the grasp member along a handle path between an outreached-position that is at or near the selected one of said various positions on the curved arc (for example point 50 or point 52), and a retracted-position that is at or near shoulder-point SP1.

Figure 4:
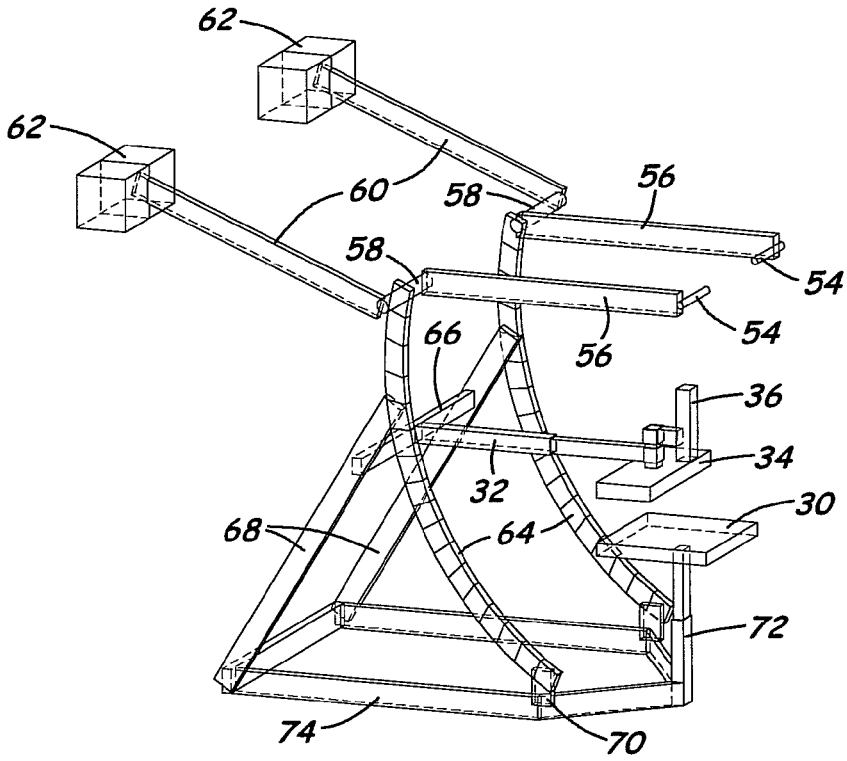
FIG. 4 shows a perspective view of a second embodiment of the invented machine.

A second embodiment will now be described with reference to FIGS. 4 and 5. FIG. 4 shows a perspective of the machine in which the grasp point is in the overhead position. Here the grasp points 54 are at one end of members 56, and the other end of members 56 are attached to pivoted shafts 58. A second pair of members 60 have one of their ends attached to pivoted shafts 58 and their other ends have a weight 62 attached to them. Members 56 are one, but not the only, example of grasp arms that may be provided to locate and/or control the grasp points during the exercise. Members 60 are one, but not the only, example of resistance arms that may extend in direction(s) to provide resistance to the exercise. The pivoted shafts 58 are attached to curved members 64, with one end of the pivoted shafts 58 extending from one side of curved members 64 and attached to members 56, and the other end of each pivoted shaft 58 extending to the other side of members 64 and attached to members 60. The members described above (assembly of pivoted members 58 with attached members 56 and 60) form a pair of mirror images of each other one, for each hand of the user. Member 32 supporting chest and leg rests (36, 34 respectively) are attached to cross member 66 which connects together sloping members 68 which support curved members 64. Curved members 64 are also supported by short members 70. Member 72, which supports the seat 28, and members 68, and 70 are all supported by frame 74, which rests on the floor. Alternatively, pivoted shaft 58 can extend all the way between two curved members 64, provided it does not interfere with the movement of the user or any of the rotating members. Many different bars and attachments can also be placed at the grasp point, positioning the hands a variety of distances apart and at a variety of different angles.

When in use, the user sits on seat 30 and grasps and pulls down on the grasp point 54 represented by the two, spaced apart handles that extend transversely to the length of members 56. As the grasp point is pulled down, it rotates about pivoted shaft 58, tracing out arc 76 and rotating member 60 and weight 62 about arc 78 (see FIG. 5), in a vertical pull-down movement. The legs of the user are placed under leg rest 34 similar to the previous embodiment. It is preferable that member 56 is at approximately horizontal when the movement is approximately half way to completion. This ensures that there is minimum horizontal movement of the grasp point as the movement is carried out. Member 60 is preferably approximately horizontal when the movement is started. Thus, as the movement is performed, member 60 and weight 62 rotate about pivoted shaft 58 and the moment required to lift the weight is reduced. This matches the force that can be exerted by the muscles of the back and that reduces as the movement is performed and the hands become closer to the body. Members 56 and 60 are to either side of curved member 64, so that movement of member 60 with pivoted shaft 58 does not interfere with the user or member 56. Members 56 and 60 may alternatively be on the same side of curved member 64 provided the movement of member 60 does not interfere with the movement of the user or member 56. The weight of weight 62 can be adjusted by adding or removing weight, for example, to suit different strengths of user.

The pivot 58 can be moved to position 80 (see FIG. 5), allowing the arms of the user to be at approximately 45 degrees when in the initial position of the movement, and the shoulder joint of the user to remain in approximately the same position as it is during the vertical pull down movement. In this position, the grasp point traces out arc 82. It is again preferred that member 56 is perpendicular to the direction of movement of the grasp point when the exercise is approximately half completed. This keeps movement of the grasp point out of the desired direction of the movement to a minimum. Thus, in tracing arc 82, member 56 is no longer horizontal when the movement is half way to completion, but is at approximately 45 degrees. As shown in FIG. 5, the angle between members 56 and 60 may be different from the angle when the grasp point is positioned above the head of the user and tracing arc 76 (in the vertical pull-down movement). This is in order to keep the angle member 60 relative to horizontal preferably the same, and the force or moment required to rotate weight 62 on the end of member 60 about pivot 58 preferably the same. If the angle between members 56 and 60 were to remain the same as the angle between them during the vertical pull down movement, weight 62 might be, or might rotate during the arc 82 exercise to be, below the pivot (80), and even come close to or hit the ground. Therefore, the angle between member 60 and member 56 may be adjusted, prior to a particular exercise, to an angle that provides the desired resistance (force, and/or moment) for the movement. This adjustment may comprise member 60 being loosened or disconnected from its normal rigid connection to member 56, moved to another angle relative to the member 56, and then re-fastened/re-tightened in the new angle for normal operation. During normal operation, member 60 is rigidly connected to member 56, for example, by being immovable fixed directly or indirectly to member 56, or being rigidly connected to the pivotal shaft 58 (which in turn may be rigidly connected to member 56) or to another member that is intended to operatively connect member 60 to member 56. During normal operation, preferably an entire unit comprising grasp point 54, member 56, pivotal shaft 58, and member 60 pivots relative to curved member 64, without relative movement between the grasp point 54, member 56, shaft 58, and member 60, except optionally for some swivel or movement of the grasp point 54 relative to member 56 for hand or wrist comfort.

Figure 5:
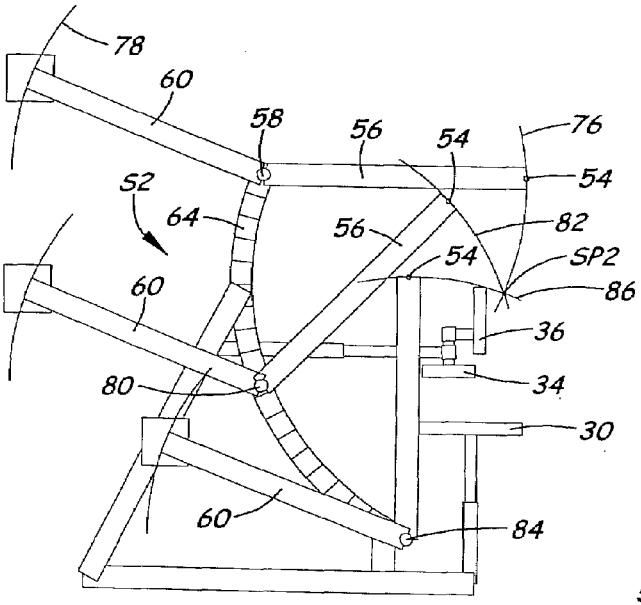
FIG. 5 shows a side elevation of the embodiment of FIG. 4, illustrating in this one drawing three of many possible positions of the pivot point for the grasp point arms and the resistance arms for performing exercises along three paths.

When the pivot is moved along curved member 64 to point 84 in FIG. 5, the movement becomes a horizontal or rowing movement. Here, the movement of the grasp point is along arc 86 with member 56 being perpendicular to the direction of movement, or approximately vertical, when the exercise is half way to completion. The angle between member 56 and member 60 is now different again, keeping the moment required to perform the exercise approximately the same.

The angles of members 56 and 60 therefore change depending on the angle of the arms of the user at the initial part of the exercise from which the pulling movement is carried out. Member 56 is approximately horizontal when vertical pull down exercise (the highest of the three positions on curved member 64 shown in FIG. 5) is half way to completion, and is approximately vertical when a horizontal rowing movement (the lowest of the three positions on the curved member 64 shown in FIG. 5) is half way to completion. Member 60 preferably remains at the same angle to the horizontal at all positions of pivoted shaft 58 on curved member 64. Thus, members 56 and 60 must be able to change angles with each other and pivoted shaft 58. Methods of achieving such an adjustment are known and usually include allowing member 56 to rotate on pivoted shaft 58 and locking it in place with a pin passed through a hole in member 56 and through one of a series of holes in a plate fixed to pivoted shaft 58. The holes in the plate are placed on a circular arc centered around the pivoted shaft 58. Thus, the force of the exercise is transferred to shaft 58 by a shear force in the pin placed in the holes in member 56 and the shaft. Member 60 can be maintained approximately horizontal to the ground by fixing an adjustable stop to the housing which supports pivoted shaft 58 and is movable along curved members 64 with pivoted shaft 58.

If the grasp points 54 are connected together, then the grasp point(s)/handles need be supported from only one side and only one of each of the members 56, 58, 60, 62 and 64 are required. In other words, a single curved member 64 or other single-sided (rather than mirror image) attachment system for member 56 may be provided, and a single member 56 with a cooperating resistance system may be provided. In such cases, a single grasp point/handle 54 may be horizontally long enough to extend across over or in front of the user so that the user may grasp the single point/handle 54 with both hands. Alternatively, two grasp points/handles 54 may extend from a single member 56, for example, in an upside-down V- or U-shaped handle arrangement (similar to the handle arrangement in FIG. 6). Such "single-sided" rather than "mirror-image" designs may allow easier access to the machine and reduce the weight and complexity of the machine.

Figure 5B:
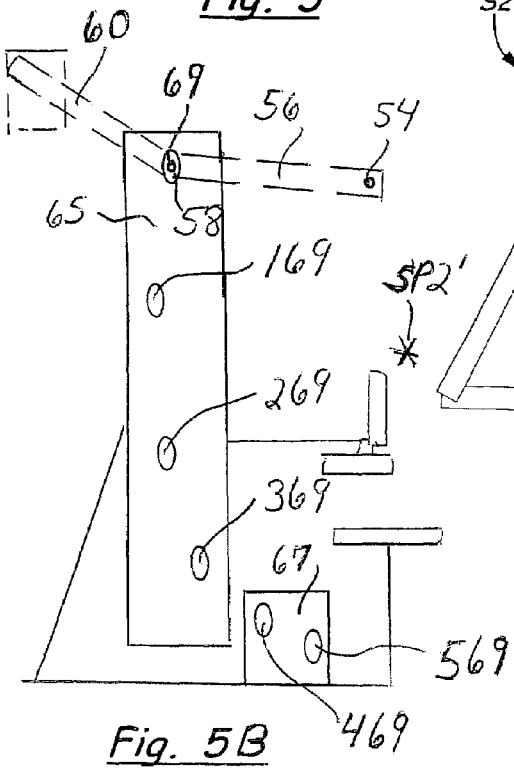
FIG. 5B schematically illustrates an alternative embodiment wherein an aim may be pivotally connected at a plurality of attachment points on one or more members that are not a curved arm or curved member.

As in the previous embodiment, the seat, chest rest and leg rest can be made adjustable, and the leg and chest rests removable. Also, curved member 64 is not strictly required, but is preferred as it may provide continuous or near continuous adjustment of the pivoted shafts along preferably the entire length of curved members 64. Alternatively, other support structure may be provided that is not a curved member and/or is not continuous, but rather just provides a number of points to support pivoted shafts 58 in a number of positions approximately on the arc of curved member 64 centered on the shoulder joint of the user. For example, FIG. 5B schematically illustrates an alternative machine wherein two upright members 65, 67 provide a plurality of attachment points 69, 169, 269, 369, 469, 569 to which the members/aims 56, 60 may be pivotally connected. As in the embodiment of FIGS. 4 and 5, member 56 is preferably rigidly connected to member 60 during use, so that members 56 and 60 move as a single unit, pivoting on shaft 58. As in the embodiment of FIGS. 4 and 5, member 60 may be detached and then re-affixed to the member 56 and/or shaft 58, or otherwise adjusted, to various angles relative to member 56 to provide the desired resistance. By adjusting/moving the member 56 to the various attachment points 69, 169, 269, 369, 469, 569, member 56 may be positioned in multiple positions on an imaginary arc that has as it center shoulder-point SP2', which is generally above the seat and at or near the user's shoulder. Alternatively, other attachment point systems and/or other resistance systems may be provided, including cable and pulley systems.

Figure 5A:
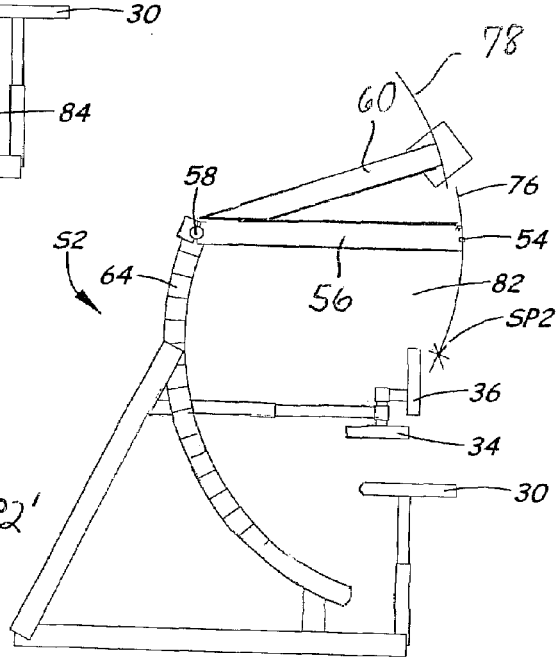
FIG. 5A illustrates the embodiment of FIGS. 4 and 5, wherein the resistance system has been adjusted, in this case by swinging the weighted arm about 160 degrees and fixing the weighted arm again to the pivotal shaft, to a position wherein the exercise movement comprises lifting member 56, resisted by the weight of arm 60 and its weight. This type of adjustment, therefore, places the weighted arm on the same side of the curved member as the user.

This embodiment can also be used for exercising the chest muscles Here members 60 are rotated approximately 160 degrees in a clockwise direction from their positions shown in FIG. 5, for example, to place the member 60 in the position shown in FIG. 5A. They are then locked in position back to pivoted shaft 58. The weights on the end of members 60 are now lifted when grasp point 54 is pushed away from the user. It is preferable to provide a seat back above seat 30 for the user to rest against when performing horizontal pushing movements for the chest.

It may be said that the embodiment in FIGS. 4 and 5 comprises a stand S2 and a grasp member that is moveable on the stand to various positions relative to the seat 30 on which the user sits, and, therefore, relative to the user and his shoulder. The various positions define a curved arc centered at a shoulder-point SP2, as shown in FIG. 5, which is above the seat 30 and generally corresponding to the location of the shoulder of the user of the machine. With the grasp member selectively located at one of said various positions, the user moves the handle of the grasp member along a handle path (for example, 76, 82, or 86 in FIG. 5) between an outreached-position that is at or near the curved arc, and a retracted-position that is at or near shoulder-point SP2. In each of said various positions, grasp members 56 constrain movement of the handles 54 along a respective handle path 76, 82, 86, and, therefore, each handle path may be called a stable path.

A further embodiment will now be described with reference to FIG. 6. This embodiment allows the muscles of the back, chest and shoulders to be exercised with the user seated in the same position. This comprises floor plates 88 90 fixed to these plates are four legs 92 94. Fixed to the top of legs 92 94 are members 96 98. Members 96 98 contain pivot 100. Arm 102 is pivoted at 100 and extends from pivot 100. Cross member 104 extends from the opposite end of arm 102 from the pivoted end 100. Emerging from cross member 104 are two bars 106 with handles 108 fixed to their ends. Fixed to the end of floor plate 90 is seat support member 110 supporting seat 112. Rod 114 extends from pivot 100 and weight arm 116 is rotatably fixed to the end of rod 114. Curved plate 118 is fixed to arm 102 with its axis about pivot 100. Curved plate 118 has a number of holes in it which line up with a hole in plate 120 fixed between members 96 98. Member 122 is attached to leg 94 and has a second member 124 fixed to it with pads 126 and 128 fixed to it. Member 122 can be removed from leg 94.

Figure 7:
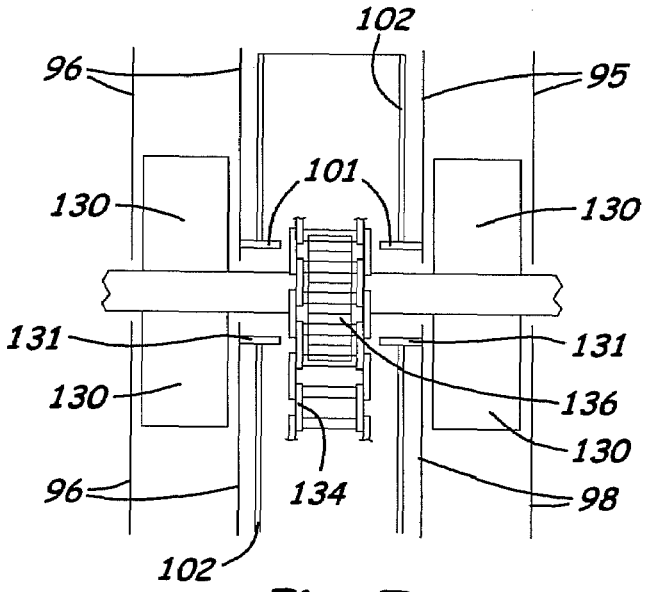
FIG. 7 shows a plan view of part of the machine of FIG. 6 in cross section.
Figure 8:
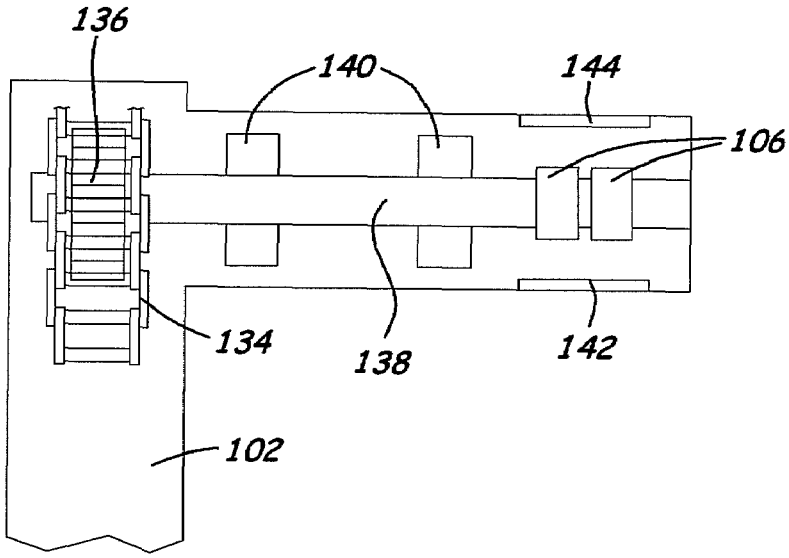
FIG. 8 shows a plan view of a cross section of another part of the machine of FIGS. 6 and 7.

A plan view of a horizontal cross section of arm 102 at pivot 100 is shown in FIG. 7. This shows members 96, 98, arm 102 and rod 114. Rod 114 runs in bearings 130. Fixed to rod 114 is sprocket 132, with chain 134. Two short length tubes 131 form pivot 100 which are fixed to the sides of members 96 98 and pass through holes equal to their outer diameter in aim 102. A cross sectional plan of cross member 104 and the top end of arm 102 is shown in FIG. 8. Chain 134 runs on sprocket 136 which is attached to shaft 138 running in bearings 140.

The other end of shaft 138 is attached to bars 106. Stops 142 and 144 on cross member 104 prevent bars 106 rotating in a full circle.

Figure 6:
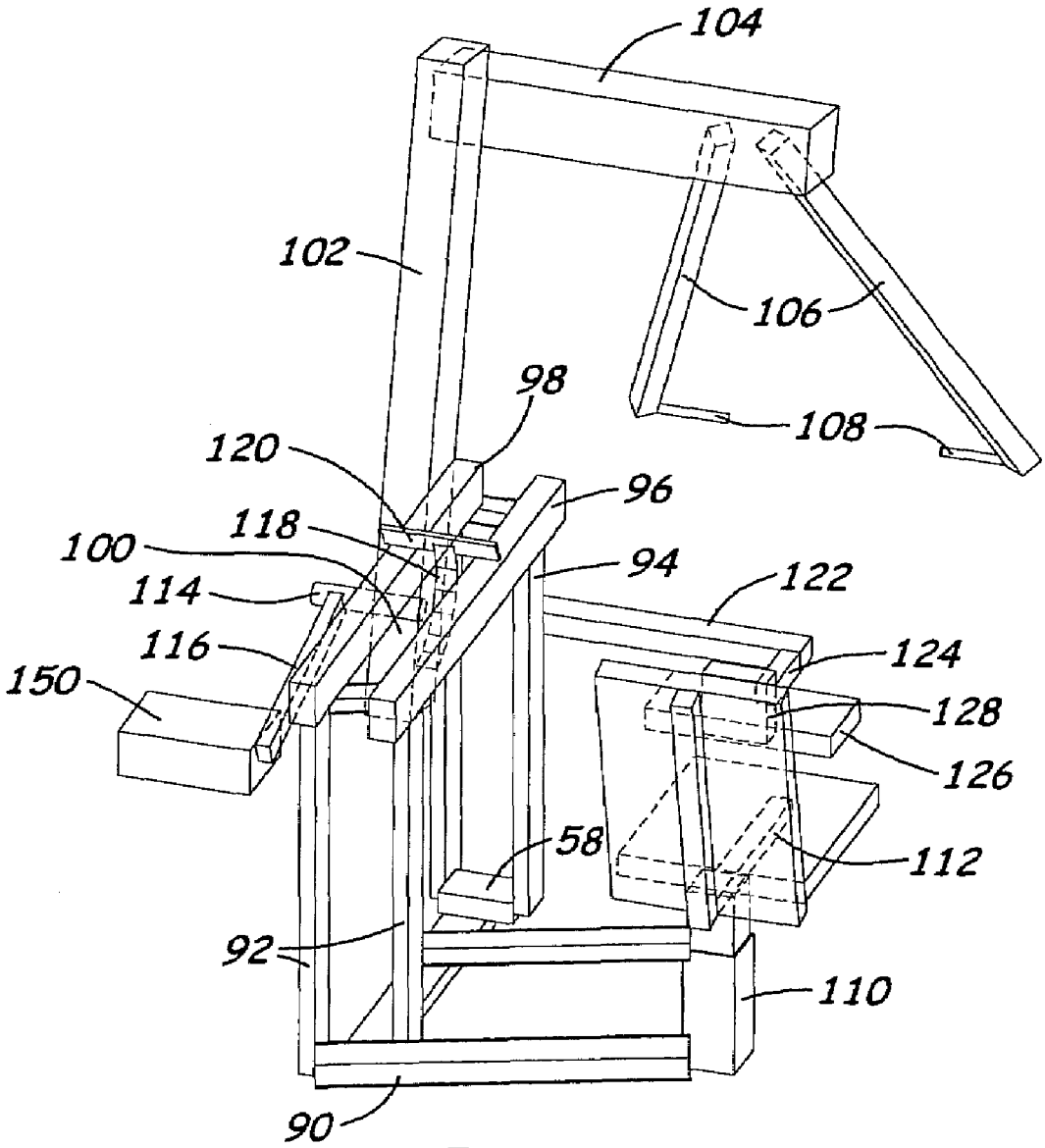
FIG. 6 shows a perspective view of a machine according to a third embodiment of the invention.
Figure 9:
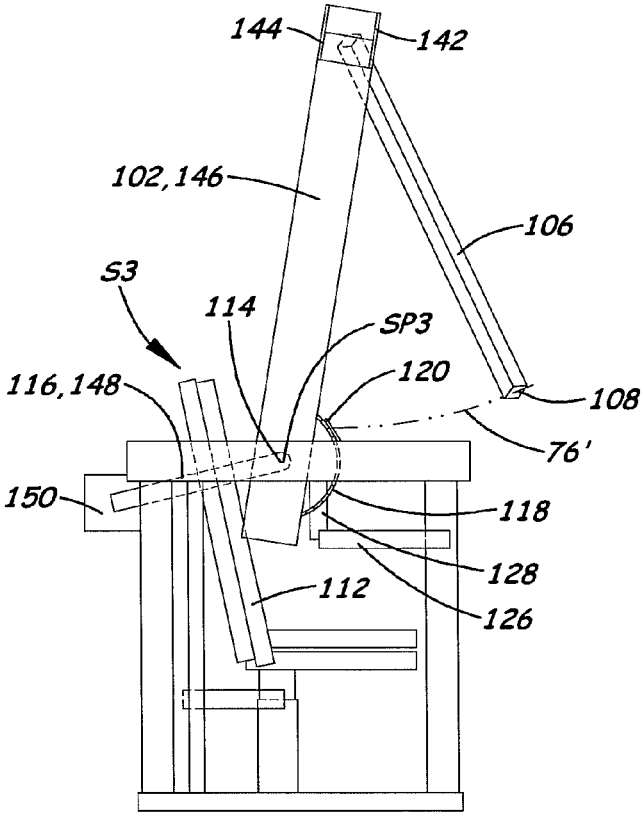
FIG. 9 shows a side elevation of one position of the machine of FIGS. 6-8.

To perform a horizontal pulling exercise such as rowing arm 102 is fixed in position 146 shown in FIGS. 6 and 9 with a pin placed in a hole in curved plate 118 and plate 120. Weight arm 116 is rotated on rod 114 until it is in position 148 FIG. 9, and then fixed to rod 114 by, for example placing a pin through holes in the end of weight arm 116 and rod 114. Weights 150 are then placed on the end of weight arm 116. The weights push down on weight arm 116 and turn rod 114 turning sprocket 132 and turning chain 134 about sprocket 132, turning shaft 138 and pushing bars 106 and handles 108 forwards away from seat 112. Bars 106 rest on stop 142. The user then sits on seat 112 with his legs under pad 126 and his chest against pad 128 and grasps handles 108 and pulls on them. This then rotates shaft 138 and lifts weight 150 to provide resistance to the exercise by turning chain 134 and rod 114 in the reverse direction to that described above. The chest of the user is placed against pad 128 to prevent the user from moving forwards as he pulls the grasp point, handles 108, towards him.

Figure 10:
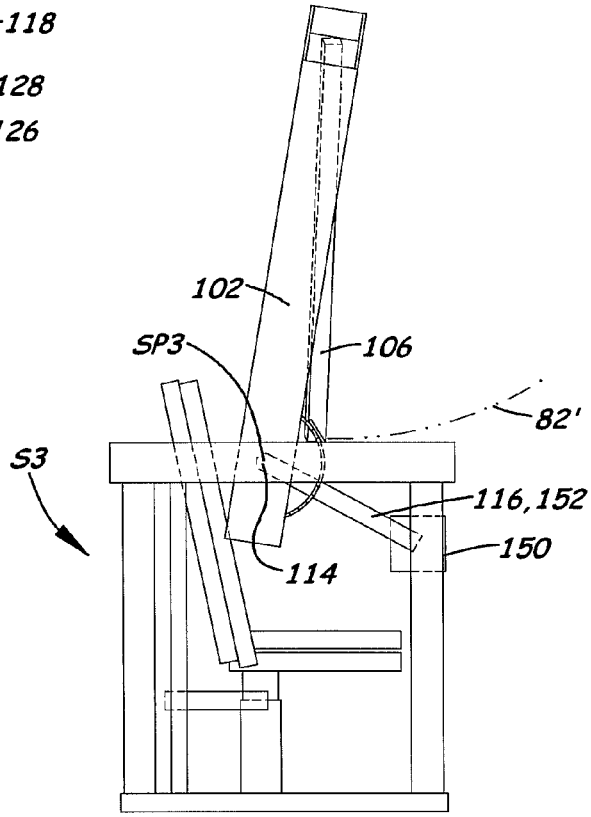
FIG. 10 shows a side elevation another position of the machine of FIGS. 6-9.

A chest press or horizontal pushing exercise is performed by rotating weight arm 116 to position 152, FIG. 10, and fixing it to rod 114. Weights placed on the end of arm 116 now rotate bars 106 and handles 108 towards seat 112 and causing bars 106 to rest on stop 144. The user then sits on seat 112, grasps handles 108 and pushes then horizontally away from his chest. This rotates shaft 138 turning chain 134 rotating rod 114 and lifting the weight on weight arm 116. Thus in the manner described above a row or pulling exercise can be performed with the machine in the same position as for a chest press or pushing exercise.

Figure 11:
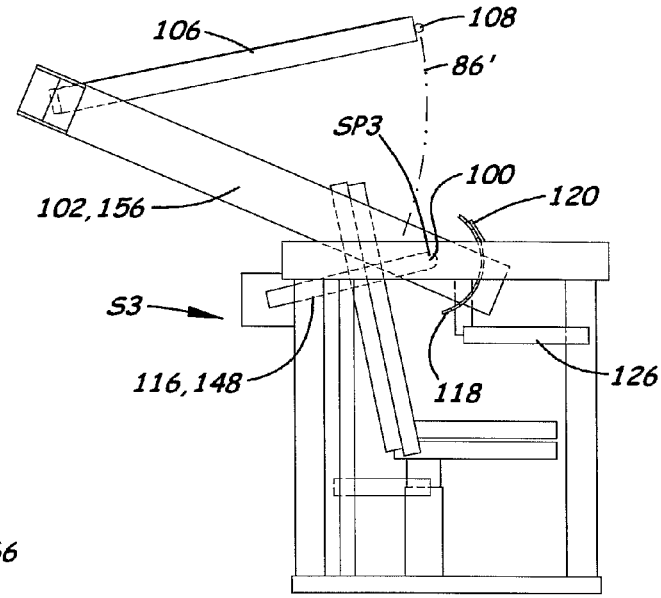
FIG. 11 shows a side elevation of yet another position of the machine of FIGS. 6-10.
Figure 12:
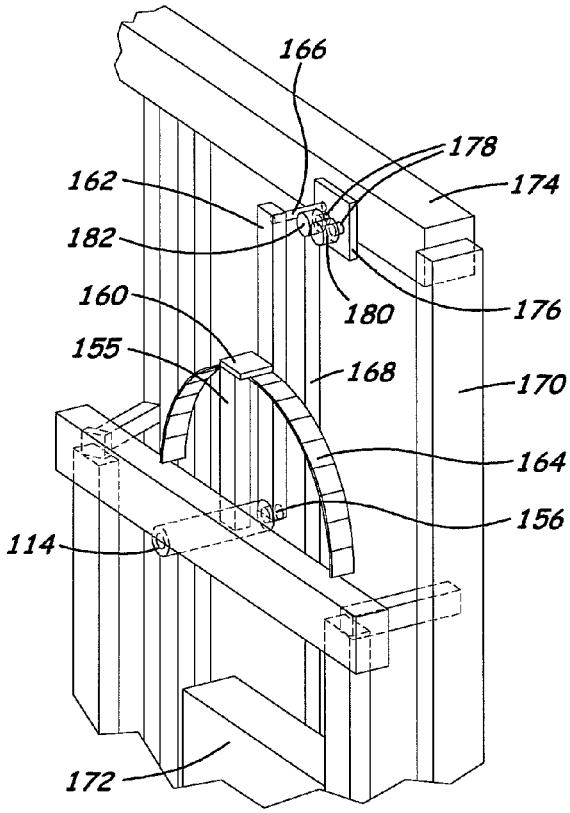
FIG. 12 shows a variation of the general type of machine of FIGS. 6-11.

Vertical movements such as pull down exercises for the back and push up exercises for the shoulders are carried out with aim 102 is rotated about pivot 100 to position 154 shown in FIG. 11. Pivot 100 is positioned just below the shoulder joint of the user and so rotation of arm 102 places bars 106 in an approximately horizontal position, which allows the grasp point, handles 108, to be moved in an approximately vertical direction above the head of the user. A pin is placed through the holes in curved plate 118 and plate 120 holding aim 102 in place. To perform a pull down exercise for the back, weight arm 116 is rotated and locked in position 148. Weights are placed on the end of the weight arm and this pushes bars 106 and handles 108 vertically upwards. The user then sits on the seat with his legs under pad 126 and grasps handles 108, the grasp point, and pulls down on it. This rotates shaft 138, chain 134, rod 114 and weight arm 116 lifting the weight and providing resistance to the pull down movement. Pad 126 prevents the user lifting himself up and as the weight is pulled down.

To perform vertical shoulder press or push up movements, weight arm 116 is rotated to position 152 and weights placed on its end. The weights push down on weight arm 116 causing bars 106 to be pushed down to rest on stop 144. The user then sits on seat 112 and grasps handles 108 and pushes up on them. This works through the shaft, chain and bar to lift the weight and provide resistance to the exercise.

When the machine is used for vertical pulling movements position 152 of weight arm 116 on FIG. 11 is the same as position 152 on FIG. 9 for horizontal pulling movements. This ensures that rotation of weight arm 116 causes weight 150 to be lifted. However in position 152 weight arm 116 is at a different angle to rod 114 for the two different movements. This is because when arm 102 is rotated from the position shown in FIG. 10 to FIG. 11 bars 106 being fixed and holding chain 134, rod 114 rotates with am 102. Thus it is preferable to provide a means of fixing weight aim 116 to rod 114 in several different positions.

The machine can also be used to perform pushing or pulling exercises between any angle between horizontal and vertical. This is achieved by rotating arm 102 to a position between positions 146 and 154. Weight aim 116 is rotated to either position 148 or 152 and handles 108 grasped and either pulled or pushed. An angle of arm 102 mid way between the angles shown in FIGS. 9 and 11 places bars 106 to allow the pushing or pulling movements to be performed at an angle of approximately 45 degrees. A pushing movement at this angle utilizes the muscles of the chest and shoulders. A pulling movement utilizes many of the back muscles. There are a number of holes in curved plate 118 which fixes arm 102 in position allowing the direction of exercises to be performed at different angles.

It may be said that the embodiment in FIGS. 6-14 comprises a stand S3 and a grasp member that is moveable on the stand to various positions relative to the seat on which the user sits, and, therefore, relative to the user and his shoulder. The various positions define a curved arc centered at a shoulder-point SP3, as shown in FIGS. 9-11, which is above the seat and approximately corresponding to the location of the shoulder of the user of the machine. With the grasp member selectively located at one of said various positions, the user moves the handle of the grasp member along a handle path (for example, 76', 82', or 86' in FIGS. 9-11) between an out-reached-position that is at or near the curved arc, and a retracted-position that is at or near shoulder-point SP3. In each of said various positions, arm 102, cross member 104, and bars 106 cooperate to constrain movement of the handles 54 along a respective handle path, and, therefore, each handle path may be called a stable path.

In the above embodiment the seat and the user remain in the same position and pushing or pulling exercises can be performed at any angle between horizontal or below and vertical or above. This gives a smaller more compact machine which utilizes the same components for pulling or pushing exercises at any angle. In the above embodiment the resistance is provided by the rotation of a weighted arm. This can be replaced with the system shown in FIG. 12. Here rod 114 is a hollow tube and has a further rod 156 inside it. The end of tube 114 is connected to am 158. On the end of this aim is plate 160 with a hole in it. The end of rod 156 is connected to a further arm 162. Connected to am 162 at approximately half its length is curved member 164 with a series of holes in it. Connected to the end of further am 162 is short member 166 which holds tape 168. Frame 170 surrounds weight 172. Top member 174 of frame 170 has plate 176 fixed to its center. Plate 176 supports shafts 178 which carry rollers 180 182. Tape 168 passes between rollers 180 182 and is connected to weight 172.

When in use aim 102 is rotated to the desired angle for the exercise. Aim 102 rotates on short length tubes 131. It is preferable that a catch not shown, attached to cross member 104 at stops 142 144, holds bars 106 against stop 142 or 144. Rotation of arm 102 rotates tube 114 via chain 134 as previously described. This rotates arm 158. When arm 102 is at the desired angle, the user rotates arm 158 to line the hole in plate 176 up with the nearest hole in curved member 164. A pin is then placed in the holes in plate 176 curved member 164. Exercises can then be performed with the user pushing or pulling on handles 108 which rotates tube 114 via chain 134 and rotating aim 158 and further arm 162 via plate 160 and curved member 164. Rotating further arm 162 pulls tape 168 over and away from roller 180 which lifts weight 172 providing resistance to the exercise.

If a horizontal pulling exercise is to be performed then bars 84 are first pushed away from the seat. Bars 106 are preferably held against stop 142 with a catch. When aim 158 is moved by the user to line it up with curved member 164, it is pulled towards the seat, or the back of the machine. This tightens the top or the side of chain 134 on the back side of the machine and pushes bars 106 against stop 142. Thus as soon as handles 108 are pulled on to perform the exercise, the weight is lifted straight away and there is no movement of bars 106 to tighten chain 134 before the weight is lifted.

During the weight lifting portion of pulling exercises arm 158 is rotated away from seat 112 this pulls tape 168 over roller 180 and lifts the weight. It is the rotation of further arm 162 and member 166 fixed to tape 168 moving the end of tape 168 away from roller 180 which lifts the weight. The passage of tape 168 over roller 180 causes roller 180 to rotate. This is a source of friction which is minimized by using bearings as rollers 180 182. Needle bearings are preferred because their small cross section keeps their overall diameter small whilst allowing them to run shaft 178 which is of relatively large diameter and therefore strong. Shafts 178 which carry rollers or bearings 180 182 have to be strong enough to carry the full weight of the maximum required resistance to the exercise. It is important that rollers 180 and 182 are close to each other and of small diameter because the weight is not lifted until member 166 has pulled tape 168 passed the highest point of either roller 180 or 182. This ensures that resistance is felt as soon as the exercise movement is started.

If the machine is to be used for pushing exercises with arm 102 in the same position as for pushing exercises, then the pin holding curved member 164 to plate 160 is removed. This disconnects bars 106 from lifting any weights and allows the user to pull them toward the seat and against stop 144 and preferably hold them in place with a catch. This causes chain 134 to rotate tube 114 and arm 158 but not further arm 162. Rotating arm 162 lifts weights 172 and it is easier for tube 114 to rotate around further rod 156 rotating arm 158. As the user pulls on bars 106 arm 158 moves forward away from the seat and then stops as bars 106 hit stop 144. The user then pushes arm 158 away from the seat until it stops and starts to push bars 106 further back against stop 144 at this point the hole in plate 160 should line up with a hole in curved member 164. If these holes do not line up it may be necessary for the user to move arm 158 slightly back towards the seat. A pin is then placed in the holes in plate 160 and curved member 164. The pushing exercise can now be performed.

When arm 102 is rotated to a different position to perform pushing or pulling exercises along a different angle, the pin connecting curved member 164 to plate 160 is removed. Bars 106 are preferably locked with a catch at either stop 142 or 144 so they move with arm 102. Arm 102 is then rotated to the desired angle. If the end of arm 102 is rotated downwards to perform vertical movements, chain 134 causes arm 158 to also rotate downwards with arm 102. Thus when arm 158 and plate 160 is subsequently rotated by the user towards the seat to line its hole up with a hole in curved member 164, to perform a pull down movement for example, it lines up with a hole further backwards and downwards on curved member 164 than it did when performing a horizontal pulling movement.

The above method of providing resistance to the exercise is easier to use and allows a weight stack to be used rather then the user lifting weights onto the end of an arm.

Figure 13:
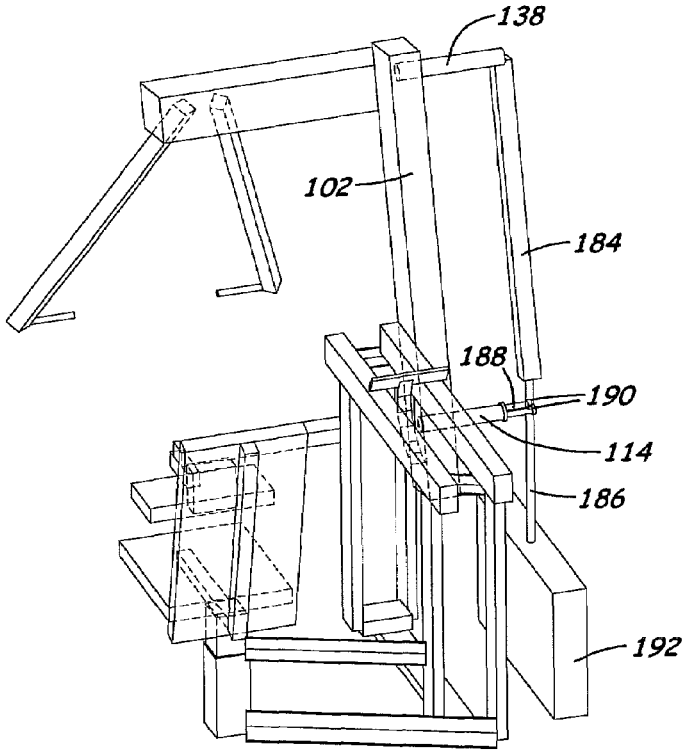
FIG. 13 shows another variation of the general type of machine of FIGS. 6-11.

In a further embodiment shown in FIG. 13 an arm 184 similar to weight aim 116 is rotatable fixed to the end of shaft 138. A tape 186 is fixed to the end aim 184. Rod 114 is now fixed to arm 102 and rotates with arm 102 as arm 102 is rotated to allow exercises in different directions. Fixed to rod 114 in line with weight arm 184 are a pair of shafts 188 and rollers 190 similar to shafts 178 and rollers 180 182. Tape 186 passes through between rollers 190 and down to weight 192.

To prepare the machine for pulling exercises arm 184 is free to rotate on shaft 138. The user pushes bars 106 forwards or upwards until they are against stop 142. Then arm 184 is fixed to shaft 138. The exercise is then performed with the user pulling on handles 108. This rotates shaft 138 turning arm 184 and pulling tape 186 over rollers 190 and lifting weight 192.

In this embodiment there are only two positions which it is possible to fix arm 184 to shaft 138. These positions are when bars 106 are furthest from the seat for the start of pulling exercises and arm 184 is in line with rollers 190. The other position is when bars 106 are closest to the seat against stop 144 for the start of pushing exercises and arm 184 is in line with rollers 190. Only these two positions are required because the rollers are fixed to rod 114 which is fixed to arms 102. Thus when arms 102 are rotated to change the angle of the exercise, shafts 188 and rollers 190 rotate with rod 114. A line drawn between the centers of shafts 188 is always perpendicular to aim 102, and arm 184 when no exercises are being performed.

An alternative arrangement to the above embodiment is to remove tape 186 shafts 188 rollers 190 and weights 192. Weights are then placed on the end of arm 184 to provide resistance to the exercise. Arm 184 is now rotatable on shaft 138 and can be locked in many positions to ensure that the movement of bars 106 to perform the exercise makes arm 184 and any weights on the end of arm 184 rotate upwards. The weights placed on the end of arm 184 are however high above the ground, particularly when arm 102 is approximately vertical for exercise movements in a horizontal direction.

As shown in the above embodiment it is not necessary for the axis of rotation of arm 102 to be the same as the axis of rotation of any means of providing resistance to the exercise. Other methods may be used to provide resistance to the exercises in the embodiments such as rotating arms acting with cables and pulleys. Electromagnetic resistance may also be used.

Figure 14:
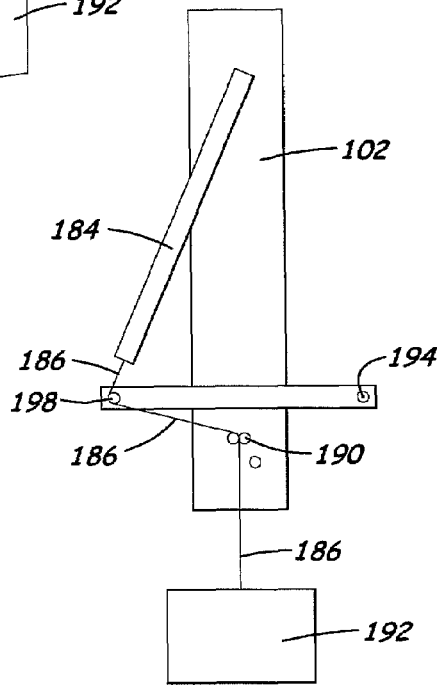
FIG. 14 shows a side elevation of yet a further variation of the general type of machine of FIGS. 6-11.

A further embodiment is shown in FIG. 14 which is similar to that shown in FIG. 13. This embodiment has one end of member 184 permanently fixed to the end of rod 138. Rollers 190 may free to rotate as a pair about rod 114, or may be fixed to am 102 at rod 114 such that they rotate with am 102. Rollers 196 and 198 are supported at either end of roller support arm 194 which is fixed to arm 102. Weight arm 184, rollers 196, 198, 190 are and weight 192 are all positioned in the same plane such that the end of tape 186 can be connected to the end of weight aim 184 and be passed around either roller 196 or 198 and between rollers 190 and down to weight 192. Tape 186 is removable from the end of weight arm 186, so may have a ring on its end which fixes to a hook in the end of weight arm 186 for example.

To perform horizontal pushing exercises such as the chest press, the user moves arm 184 to a position close to the roller 198, this moves bars 106 to the rear of the machine, to the start position of the pushing exercise. Tape 186 is passed around the outside of roller 198 and connected to the end of weight arm 184. The exercise is then performed with the user pushing on bars 106 forwards. The end of arm 184 connected to the end of tape 186 to move towards roller 194. This passes tape 186 around roller 198 and between rollers 190 lifting weight 192, providing resistance to the movement.

Horizontal pushing movements are performed by removing tape 186 from the end of weight arm 184. Weight arm 184 is then moved forward, moving bars 106 to the start position for pulling exercises. Tape 186 is moved away from roller 198 and passed around roller 196 and connected to the end of weight arm 184. The exercise is now performed with tape 186 passing between rollers 190 lifting weight 192.

To perform vertical movements, arm 102 is rotated about rod 114 as in previous embodiments. Tape 186 is passed around roller 198 for pushing exercises and 196 for pulling exercises as for horizontal exercises. If rollers 190 are free to rotate as a pair, they rotate as a pair to find the level which passes the tape closest to the weight. If the rollers are fixed, and rotate with aim 102 the tape may pass by a longer route to weight 192.

In this embodiment it is important that of rollers 190 are close together and relatively small. This is because, as arm 102 is rotated, tape 186 passes over a different length of the circumference of one of rollers 190. This effectively makes tape 186 shorter, which has to be taken up either by lifting weight 192 or placing weight am 184 and bars 106 in a different position for the start of the exercise. For a shoulder press exercise for example, am 102 may be 25 degrees above horizontal, placing roller 198 well below rollers 190. This causes tape 186 to pass around perhaps 130 degrees of one of rollers 190, shortening the tape. When arm 102 is vertical, roller 198 is above rollers 190 so tape 186 may pass over only 70 degrees of one of rollers 190 which lengthens the tape.

Tape 186 may be replaced with a wire or rope, and rollers 190 196 and 198 may be replaced with pulleys containing a groove for the wire or rope to lie in.

In the above embodiments which use arm 102 the height of seat 112 can be made adjustable to accommodate different sizes of user, or slightly alter the direction of the exercise. It is possible to make the seat move in horizontal direction to alter the direction of the exercise. The positions of chest pad 128 and leg pad 126 can also be adjustable. It is preferred that in the embodiments that use arm 102 that during horizontal movements bars 106 are vertical when the exercise is half way to completion as in the second embodiment. Also in these embodiments it is possible to pass the tape or rope which is fixed to the weight around further rollers or pulleys to a weight which is not positioned directly below rollers 180, 182 or 190.

It is also possible to pivot a track or means of providing a straight path for the exercise movement to travel along which is pivoted approximately at the shoulder joint of the user. The track may be similar to a smith machine. As said track or means of providing a straight path would constrain the exercise movement in said straight path, said path could be called a stable path. The exercise movement may also be performed along a track which is moved along a member such as member 4 in the first embodiment (FIG. 1) or curved member 64 in the embodiment shown in FIG. 5, the track being moved along the member 4 or 64 such that it points approximately towards the shoulder joint of the user.

Arm, 102 and cross member 104 can be are heavy and the user may find it difficult to lift them to change the angle of the direction of the exercise. The movement of arm 102 can be assisted some means such as placing gas struts or springs between aim 102 and legs 92 for example.

The weights referred to in the above embodiments can take the form of weight stacks comprising a number of flat plate like weights with a hole in their centers and a rod with holes corresponding to each weight. A pin is placed through a further hole in each weight and the weights above that weight are lifted when the exercise is performed.

Also in all embodiments it is preferred that the means of positioning the grasp point allows it to perform exercise movements between vertical or above and horizontal or below. However it is possible that the means of positioning the grasp point only allows the direction of exercise movements to be within a small range of angles between horizontal or below and vertical or beyond.

The embodiments illustrated in FIGS. 6-14 are some, but not the only, embodiments that fall under the broad description of an exercise machine comprising: a stand; a seat for a user; a rotatable arm system comprising a generally vertical arm connected to said stand at a first pivotal connection at a side of the seat and a generally horizontal cross member extending out from the generally vertical arm, said rotatable arm system being rotatable relative to the stand so that said generally vertical arm pivots in a generally vertical plane to a plurality of positions, said generally vertical arm being adapted to be fixed in each of said plurality of positions; a grasp member having an outer end and an inner end, said outer end being connected to said cross member so that said grasp member is pivotal relative to said rotatable aim system, wherein fixing of the generally vertical arm in said plurality of positions selectively locates said outer end of the grasp member in a plurality of different locations relative to the stand, said plurality of different locations defining a first generally circular arc having as its center a shoulder-point that is above said seat near said first pivotal connection and generally corresponding to the location of the user's shoulder during use of the machine, wherein said grasp member has a handle at or near said inner end for being grasped by a user, and, wherein, when the generally vertical arm is fixed in a selected one of said plurality of positions to locate the grasp member outer end in one of said plurality of different locations, the handle is constrained by said grasp member to move in exercise movements along a respective handle path extending radially generally between a retracted-position that is at or near said shoulder-point and a respective outreached-position radially distanced from the shoulder-point and near said first generally circular arc; the exercise machine further comprising a resistance system adapted to resist pivoting of the grasp member relative to the rotatable arm system during said exercise movements; wherein said grasp member being selectively locatable provides for said exercise movements radiating generally outward from the user's shoulder at angles ranging from approximately vertically upwards to below horizontal. While it is preferred that the generally vertical arm and the generally horizontal cross member be substantially or exactly vertical and horizontal, respectively, it will be understood by those of skill in the art that the terms "generally vertical" and "generally horizontal" will include embodiments wherein said arm and cross member are not exactly vertical and horizontal and/or are curved, bent, or comprise multiple section or portions to accomplish the preferred function of extending upwards beside the user's seat and extending generally over the user seat so that the user may reach upward or forward to grasp the handles placed over or in front of the user. Preferably, but not necessarily, the exercise machine resistance system comprises a weight and a mechanical linkage between said weight and said grasp member adapted to resist pivoting of the grasp member relative to the rotatable arm system. Said mechanical linkage may be adjustable into a plurality of configurations comprising a configuration wherein pivoting the grasp member inward toward the shoulder-point raises the weight and therefore provides resistance to inwardly-directed exercise movement, and also comprising a configuration wherein pivoting the grasp member out away from the shoulder-point raises the weight and therefore provides resistance to outwardly-directed exercise movement. Machines may be structured for exercise movements that are pushing only, pulling only, or both pushing and pulling exercises.

The embodiments illustrated in FIGS. 6-14 are some, but not the only, embodiments that may be described an exercise machine comprising: a stand; a seat having a front and a rear; a generally vertical rotatable arm connected to the stand to one side of said seat and having an aim outer end; a grasp member having a member outer end and an opposing handle end, the member outer end being connected to said arm outer end by a generally horizontal rotating shaft; wherein the rotatable aim is rotatable forward and rearward into a plurality of positions to move said member outer end to a plurality of locations defining a first generally circular arc having as its center a shoulder-point that is above said seat and generally corresponding to the location of the user's shoulder during sitting on said seat, and wherein the rotatable arm is adapted to be fixed in each of said plurality of positions to fix the location of said member outer end on said arc to determine the direction of exercise movements; and wherein the grasp member rotates along with the rotating shaft relative to the rotatable aim so that the handle end is movable is said exercise movements along a handle path between an outreached-position and a retracted-position; and the exercise machine further comprising a resistance system adapted to resist rotation of said generally horizontal rotating shaft and rotation of said grasp member along with said rotating shaft relative to the rotatable aim to provide exercise as the user moves the handle end along said handle path. The plurality of positions to which the rotatable arm rotates may be generally above said seat and behind said seat. The resistance system may comprise a weight and a mechanical linkage between said weight and said grasp member adapted to resist rotation of said generally horizontal rotating shaft and rotation of said grasp member along with said rotating shaft relative to the rotatable arm. The mechanical linkage may be adjustable into a plurality of configurations comprising a configuration wherein moving the grasp member inward toward the shoulder-point raises the weight and therefore provides resistance to inwardly-directed exercise movement, and also comprising a configuration wherein moving the grasp member out away from the shoulder-point raises the weight and therefore provides resistance to outwardly-directed exercise movement. Machines may be structured for exercise movements that are pushing only, pulling only, or both pushing and pulling exercises.

It is also possible to produce a machine which exercises only one arm. The user may also have a weak grip or be disabled and may not be able to grasp the point with his hand. In this case a tape may be used to connect the arm of the user to the grasp point.

Although this invention has been described above with reference to particular means, materials and embodiments, it is to be understood that the invention is not limited to these disclosed particulars, but extends instead to all equivalents within the broad scope of the following claims.

The invention claimed is:

1. A machine for exercising, the machine comprising:

a stand having a seat for a user;

a curved member connected to the stand and having a curved length curving on a radius that is centered at or near a shoulder point generally above said seat so that the shoulder point is near a shoulder of a seated user;

an elongated, rigid grasp arm having an inner end and an outer end, a handle at or near the outer end, and a grasp arm length between said inner end and the handle, the inner end being at or near the curved member and pivotally connectable to the curved member at various connection locations along the curved length, so that the grasp arm pivots relative to the curved member when the handle is pushed or pulled by the user in an exercise movement;

a resistance system operatively connected to the grasp arm to resist the pivoting of the grasp arm relative to the curved member;

wherein the handle is constrained by said grasp arm to move, during the pivoting of the grasp arm and throughout the entire exercise movement, along a handle path that is a constant radial distance from the connection location, said constant radial distance being equal to said grasp arm length, and said handle path being between a retracted-position that is at or near said shoulder-point and a respective outreached-position distanced from the shoulder-point.

2. A machine as in claim 1, wherein said resistance system resists pivoting of said pivoting of the grasp arm when the handle is moved along said handle path from the outreached-position to the retracted-position, so that pulling movements are resisted to provide exercise to the user.

3. A machine as in claim 2, wherein said resistance system comprises a resistance arm operatively connected to the grasp arm and extending away from the curved arm in an opposite direction from the seat, said resistance arm having at or near an outer end a weight so that gravity pulls said resistance arm downward to provide resistance to the grasp arm and handle being pulled downward.

4. A machine as in claim 1, wherein said resistance system resists pivoting of said pivoting of the grasp arm when the handle is moved along said handle path from the retracted-position to the outreached-position, so that pushing movement are resisted to provide exercise to the user.

5. A machine as in claim 4, wherein said resistance system comprises a resistance arm operatively connected to the grasp arm and extending away from the curved arm in an generally toward the seat, said resistance arm having at or near an outer end a weight so that gravity pulls said resistance arm downward to provide resistance to the grasp arm and handle being pulled upward.

6. A machine as in claim 1, wherein said grasp arm is pivotally connectable in at least three pivot point positions along the curved length of the curved member.

7. A machine as in claim 1, wherein said grasp arm is locatable to at least three pivot point positions on the curved member, wherein a first of said pivot point positions places the grasp arm in a generally horizontal position above the seat for a vertical-pull-down exercise.

8. A machine as in claim 7, wherein a second of said pivot point positions places the grasp arm in a slanted position of about 45 degrees relative to horizontal in front of the seat.

9. A machine as in claim 8, wherein a third of said pivot point positions places the grasp arm in a generally vertical position in front of the seat for a rowing exercise.

10. A machine for exercising, the machine comprising:

a stand having a seat for a user;

an attachment system connected to the stand and having a plurality of attachment points arranged along a curve on a radius that is centered at or near a shoulder point generally above said seat so that the shoulder point is near a shoulder of a seated user;

an elongated rigid grasp arm having an inner end and an outer end, a handle at or near the outer end, and a grasp arm length between said inner end and the handle, the inner end being at or near the attachment system and pivotally connectable to the attachment system at any of said plurality of attachment points, so that the grasp arm pivots relative to the attachment system when the handle is pushed or pulled by the user in an exercise movement;

a resistance system operatively connected to the grasp arm to resist the pivoting of the grasp arm relative to the attachment system;

wherein the handle is constrained by said grasp arm to move, during the pivoting of the grasp arm and throughout the entire exercise movement, along a handle path that is a constant radial distance from the attachment point, said constant radial distance being equal to said grasp arm length, and said handle path being between a retracted-position that is at or near said shoulder-point and a respective outreached-position distanced from the shoulder-point.

11. A machine as in claim 10, wherein said resistance system resists pivoting of said pivoting of the grasp arm when the handle is moved along said handle path from the outreached-position to the retracted-position, so that pulling movements are resisted to provide exercise to the user.

12. A machine as in claim 11, wherein said resistance system comprises a resistance arm operatively connected to the grasp arm and extending away from the attachment system in an opposite direction from the seat, said resistance arm having at or near an outer end a weight so that gravity pulls said resistance arm downward to provide resistance to the grasp arm and handle being pulled downward.

13. A machine as in claim 10, wherein said resistance system resists pivoting of said pivoting of the grasp arm when the handle is moved along said handle path from the retracted-position to the outreached-position, so that pushing movement are resisted to provide exercise to the user.

14. A machine as in claim 13, wherein said resistance system comprises a resistance arm operatively connected to the grasp arm and extending away from the attachment system in an generally toward the seat, said resistance arm having at or near an outer end a weight so that gravity pulls said resistance arm downward to provide resistance to the grasp arm and handle being pulled upward.

15. A machine as in claim 10, wherein attachment system comprises at least three attachment points and said grasp arm is pivotally connectable in at least three positions on said attachment system.

16. A machine as in claim 15, wherein said grasp arm is locatable to at least three of said attachment points, wherein a first of said attachment points places the grasp arm in a generally horizontal position above the seat for a vertical-pull-down exercise.

17. A machine as in claim 16, wherein a second of said attachment points places the grasp arm in a slanted position of about 45 degrees relative to horizontal in front of the seat.

18. A machine as in claim 17, wherein a third of said attachment points places the grasp arm in a generally vertical position in front of the seat for a rowing exercise.

19. A machine for exercising, the machine comprising:

a stand having a seat for a user;

a curved member connected to the stand and having a curved length curving on a radius that is centered at or near a shoulder point generally above said seat so that the shoulder point is near a shoulder of a seated user;

a grasp arm pivotally connectable to the curved member in a number of positions along the curved length, and the grasp arm having a handle at an outer end, for being pushed or pulled by the user, so that the grasp arm pivots relative to the curved member;

a resistance system operatively connected to the grasp arm to resist the pivoting of the grasp arm relative to the curved member;

wherein the handle is constrained by said grasp arm to move, during the pivoting of the grasp arm, along a handle path between a retracted-position that is at or near said shoulder-point and a respective outreached-position distanced from the shoulder-point;

wherein said resistance system resists pivoting of said pivoting of the grasp arm when the handle is moved along said handle path from the outreached-position to the retracted-position, so that pulling movements are resisted to provide exercise to the user;

wherein said resistance system comprises a resistance arm operatively connected to the grasp arm and extending away from the curved arm in an opposite direction from the seat, said resistance arm having at or near an outer end a weight so that gravity pulls said resistance arm downward to provide resistance to the grasp arm and handle being pulled downward, and wherein the resistance arm is rigidly connectable to the grasp arm at different angles to the grasp arm.

20. A machine for exercising, the machine comprising:

a stand having a seat for a user;

a curved member connected to the stand and having a curved length curving on a radius that is centered at or near a shoulder point generally above said seat so that the shoulder point is near a shoulder of a seated user;

a grasp arm pivotally connectable to the curved member in a number of positions along the curved length, and the grasp arm having a handle at an outer end, for being pushed or pulled by the user, so that the grasp arm pivots relative to the curved member;

a resistance system operatively connected to the grasp arm to resist the pivoting of the grasp arm relative to the curved member;

wherein the handle is constrained by said grasp arm to move, during the pivoting of the grasp arm, along a handle path between a retracted-position that is at or near said shoulder-point and a respective outreached-position distanced from the shoulder-point;

wherein said resistance system resists pivoting of said pivoting of the grasp arm when the handle is moved along said handle path from the retracted-position to the outreached-position, so that pushing movement are resisted to provide exercise to the user;

wherein said resistance system comprises a resistance arm operatively connected to the grasp arm and extending away from the curved arm in an generally toward the seat, said resistance arm having at or near an outer end a weight so that gravity pulls said resistance arm downward to provide resistance to the grasp arm and handle being pulled upward, and wherein the resistance arm is rigidly connectable to the grasp arm at different angles to the grasp aim.

21. A machine for exercising, the machine comprising:

a stand having a seat for a user;

an attachment system connected to the stand and having a plurality of attachment points arranged along a curve on a radius that is centered at or near a shoulder point generally above said seat so that the shoulder point is near a shoulder of a seated user;

a grasp arm that is pivotally connectable to the attachment system at any of said plurality of attachment points, and the grasp arm having a handle at an outer end, for being pushed or pulled by the user, so that the grasp arm pivots relative to the attachment system;

a resistance system operatively connected to the grasp arm to resist the pivoting of the grasp arm relative to the attachment system;

wherein the handle is constrained by said grasp arm to move, during the pivoting of the grasp arm, along a handle path between a retracted-position that is at or near said shoulder-point and a respective outreached-position distanced from the shoulder-point;

wherein said resistance system resists pivoting of said pivoting of the grasp arm when the handle is moved along said handle path from the outreached-position to the retracted-position, so that pulling movements are resisted to provide exercise to the user, wherein said resistance system comprises a resistance arm operatively connected to the grasp arm and extending away from the attachment system in an opposite direction from the seat, said resistance arm having at or near an outer end a weight so that gravity pulls said resistance arm downward to provide resistance to the grasp arm and handle being pulled downward, and wherein the resistance arm is rigidly connectable to the grasp arm at different angles to the grasp arm.

22. A machine for exercising, the machine comprising:

a stand having a seat for a user;

an attachment system connected to the stand and having a plurality of attachment points arranged along a curve on a radius that is centered at or near a shoulder point generally above said seat so that the shoulder point is near a shoulder of a seated user;

a grasp arm that is pivotally connectable to the attachment system at any of said plurality of attachment points, and the grasp arm having a handle at an outer end, for being pushed or pulled by the user, so that the grasp arm pivots relative to the curved member;

a resistance system operatively connected to the grasp arm to resist the pivoting of the grasp arm relative to the curved member;

wherein the handle is constrained by said grasp arm to move during the pivoting of the grasp arm along a handle path between a retracted-position that is at or near said shoulder-point and a respective outreached-position distanced from the shoulder-point and near said curved member;

wherein said resistance system resists pivoting of said pivoting of the grasp arm when the handle is moved along said handle path from the retracted-position to the outreached-position, so that pushing movement are resisted to provide exercise to the user, wherein said resistance system comprises a resistance arm operatively connected to the grasp arm and extending away from the attachment system in an generally toward the seat, said resistance arm having at or near an outer end a weight so that gravity pulls said resistance arm downward to provide resistance to the grasp arm and handle being pulled upward, and resistance arm is rigidly connectable to the grasp arm at different angles to the grasp arm.

* * * * *